United States Patent [19]

Miyazawa et al.

[11] Patent Number: 5,072,240

[45] Date of Patent: Dec. 10, 1991

[54] ON-DEMAND TYPE INK JET PRINT HEAD

[75] Inventors: Yoshinori Miyazawa; Hidenori Omae; Masanao Matsuzawa; Hisashi Miyazawa; Takahiro Katakura; Osamu Nakamura; Norihiko Kurashima, all of Suwa, Japan

[73] Assignee: Seiko Epson Corporation, Tokyo, Japan

[21] Appl. No.: 446,734

[22] Filed: Dec. 6, 1989

[30] Foreign Application Priority Data

| | | | |
|---|---|---|---|
| Dec. 7, 1988 | [JP] | Japan | 63-309123 |
| Jan. 10, 1989 | [JP] | Japan | 1-3201 |
| Jan. 10, 1989 | [JP] | Japan | 1-3202 |
| Jan. 10, 1989 | [JP] | Japan | 1-3203 |
| Jan. 10, 1989 | [JP] | Japan | 1-3204 |
| Jan. 10, 1989 | [JP] | Japan | 1-3205 |

[51] Int. Cl.[5] ..... B41J 2/045

[52] U.S. Cl. ..... 346/140 R; 29/25.35; 310/331

[58] Field of Search ..... 346/140; 29/25.35; 310/330, 331

[56] References Cited

U.S. PATENT DOCUMENTS

| | | | |
|---|---|---|---|
| 4,072,959 | 2/1978 | Elmqvist | 346/140 |
| 4,633,121 | 12/1986 | Ogawa | 310/331 X |
| 4,768,266 | 9/1988 | DeYoung | 29/25.35 |

FOREIGN PATENT DOCUMENTS

| | | |
|---|---|---|
| 337429 | 10/1989 | European Pat. Off. . |
| 2905063 | 8/1980 | Fed. Rep. of Germany . |
| 3245283 | 6/1984 | Fed. Rep. of Germany . |
| 222859 | 9/1988 | Japan . |
| 8605722 | 10/1986 | World Int. Prop. O. . |

*Primary Examiner*—Joseph W. Hartary
*Attorney, Agent, or Firm*—Blum Kaplan

[57] ABSTRACT

An on-demand type ink jet print head including a drive assembly formed from a vibrating plate formed of a piezoelectric layer with an electrode layer on one surface and an electrically conductive, physically resilient layer on the opposite surface of the piezoelectric layer. The vibrating plate is secured to a base and has two opposing edges defining a free space therebetween. The vibrating plate is slit into a plurality of strips and these strips are cross-slit in the widthwise direction to form a row of reed pieces secured to each opposing edge of the base in a cantilever configuration and extending into the free space from each edge toward the reed pieces extending from the opposite edge with a space therebetween. The reed pieces are electrically and mechanically independent of each other and have negligible electrical and mechanical interference with each other. Selective application of an electric field to the piezoelectric layer causes the reed pieces to deflect and jet ink from the print head onto a recording medium.

36 Claims, 9 Drawing Sheets

ON-DEMAND TYPE INK JET PRINT HEAD

BACKGROUND OF THE INVENTION

The invention relates generally to an on-demand type ink jet print head, and in particular to an ink jet print head in which ink is stored in an ink tank and drops of liquid ink are jetted through print head nozzles by piezoelectric elements onto a recording medium, such as paper.

On-demand type ink jet print heads can be classified into three categories. A first type of print head is commonly referred to as a bubble jet print head. This type includes a heater located at the ink jet nozzle and ejects ink drops by vaporizing a localized portion of ink and utilizing the expansion pressure generated by the vaporized ink to force ink from the print head.

A second type of print head includes a piezoelectric element provided in a vessel defining an ink reservoir. Ink drops are ejected by force generated by localized variations in pressure in the ink reservoir caused by the deformation of the piezoelectric element.

A third type of print head includes an assembly of reed-like pieces including a piezoelectric portion in an ink reservoir having an ink drop ejection orifice. The reed pieces are positioned opposite the ink drop ejection orifice with the liquid ink present between the reed piece and the orifice are ejected due to pressure generated by piezoelectric deformation of the reed piece.

The third type of ink jet print head is described in Japanese Patent Publication No. 60-8953. This shows a print head including a housing defining an ink tank that has a plurality of nozzle openings in a wall of the housing. A reed piece having a piezoelectric portion is aligned with each nozzle opening and each reed piece is actuated by a print signal to jet drops of ink from the print head. As the print head operates, the reed piece is deformed away from the nozzle opening by an electric print signal. When the applied signal ends, the reed piece rapidly returns towards the nozzle opening due to its inherent resilient characteristics. As the reed piece returns, it causes a drop of ink to fly from the nozzle opening.

The piezoelectric element utilized in the third type of print head is shaped like a reed and is supported in cantilever form to provide a large amount of displacement. This type of print head is advantageous because ink can be ejected with high efficiency, and the ejection operation is not significantly adversely influenced by gas, dust, etc. that are inadvertently included in the ink. The operating reliability of this type of print head is very high.

However, this type of print head also has disadvantages. The assembly of reed pieces is conventionally formed by machining a piezoelectric plate into the form of a comb with the reed pieces are the teeth of the comb. Thus, all of the reed pieces are both mechanically and electrically connected on their root end to the same base portion of the piezoelectric plate. Accordingly, adjacent reed pieces influence each other both mechanically and electrically. This causes mutual interference and results in the vibration mode of each reed piece becoming unstable.

This type of print head also has manufacturing disadvantages. A comb shaped reed piece assembly is conventionally formed by making cut lines midway in a raw piezoelectric plate and leaving a root portion unmachined. Such a configuration leads to low yields and high breakage. It is also difficult to attach an electric signal wire to an electrode on the piezoelectric plate if the electrode is formed on the free vibration side of the reed piece to avoid problems associated with electrical mutual interference. Thus, conventional ink jet print heads are not fully satisfactory and have inadequacies due to these shortcomings.

Accordingly, it is desirable to provide an improved on-demand type ink jet print head which avoids the shortcomings of these prior art.

SUMMARY OF THE INVENTION

Generally speaking, in accordance with the invention, an on-demand ink jet print head including a vibrating plate of a piezoelectric plate having an electrode layer disposed on one surface and resilient metal plate on the other surface. The vibrating plate is secured to a base member having an aperture formed in the central region thereof. The vibrating plate is cut into a plurality of strips, and these strips are further cut in the widthwise direction to form a plurality of reed pieces secured to the base in a cantilever configuration. The reed pieces are electrically and mechanically independent of each other and have negligible electrical and mechanical interference with each other. Selective application of an electric field to the piezoelectric layer causes the reed pieces to displace to jet ink from the print head onto a recording medium.

Accordingly, it is an object of the invention to provide an improved on-demand type ink jet print head in which electrical and mechanical influence between reed pieces is small.

Another object of the invention is to provide a piezoelectric element for use in an on-demand type ink jet print head capable of being formed in a simple manner with high yield.

A further object of the invention is to provide a piezoelectric drive assembly for use in an on-demand type ink jet print head that can be electrically coupled to an electric signal wire on the fixed side of the element, to simplify attaching electrodes to the reed pieces.

Still another object of the invention is to provide an improved on-demand type ink jet print head having closely spaced nozzle openings.

Still a further object of the invention is to provide an improved method for forming a drive assembly for an ink jet print head.

Still other objects and advantages of the invention will in part be obvious and will in part be apparent from the specification and drawings.

The invention accordingly comprises the several steps and the relation of one or more of such steps with respect to each of the others, and the article possessing the features, properties, and the relation of elements, which are exemplified in the following detailed disclosure, and the scope of the invention will be indicated in the claims.

DESCRIPTION OF THE PREFERRED EMBODIMENTS

Figure 1:
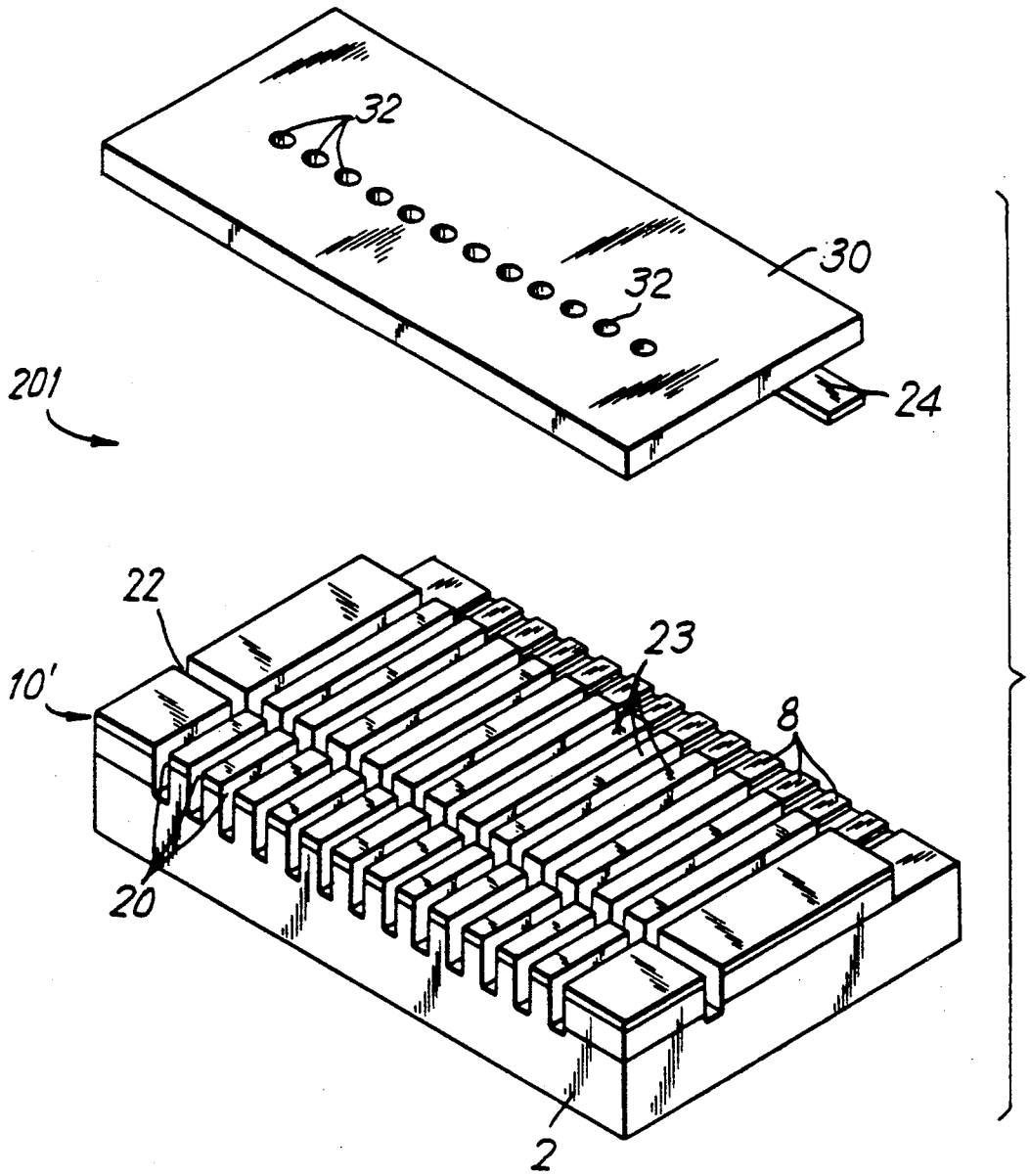
FIG. 1 is an exploded perspective view of a drive assembly for an on-demand type ink jet print head formed in accordance with the invention.

A drive assembly 201 for propelling ink from an ink jet print head constructed and arranged in accordance with the invention is shown in FIG. 1. Drive assembly 201 includes a substantially planar rectangularly shaped base member 2, preferably formed of an electrically insulating material, such as ceramic or glass coupled to a selectively vibrating piezoelectric portion 10'. Base member is formed with a rectangular through opening 4 in a central portion thereof to define a frame as shown more fully in FIG. 2A.

A first edge 6 of the upper surface of base member (frame) is formed with a plurality of electrically conductive conductor bands 8 on the surface thereof extending from the side edge to opening 4. Conductive bands 8 serve as terminals for electrically coupling a signal supply cable to a plurality of reed pieces 23 to be installed as shown in FIG. 2D. Reed pieces 23 ar elongated members to be placed over opening 4 and include a first securing end 23*a*, and a cantilever portion 23*b*. First end 23*a* of reed pieces 23 is secured to edge 6 of frame 2 and cantilever portion 23*b* of reed piece 23 is free to be deflected and swing freely to propel drops of ink after completion of assembly as follows.

Figure 2A:
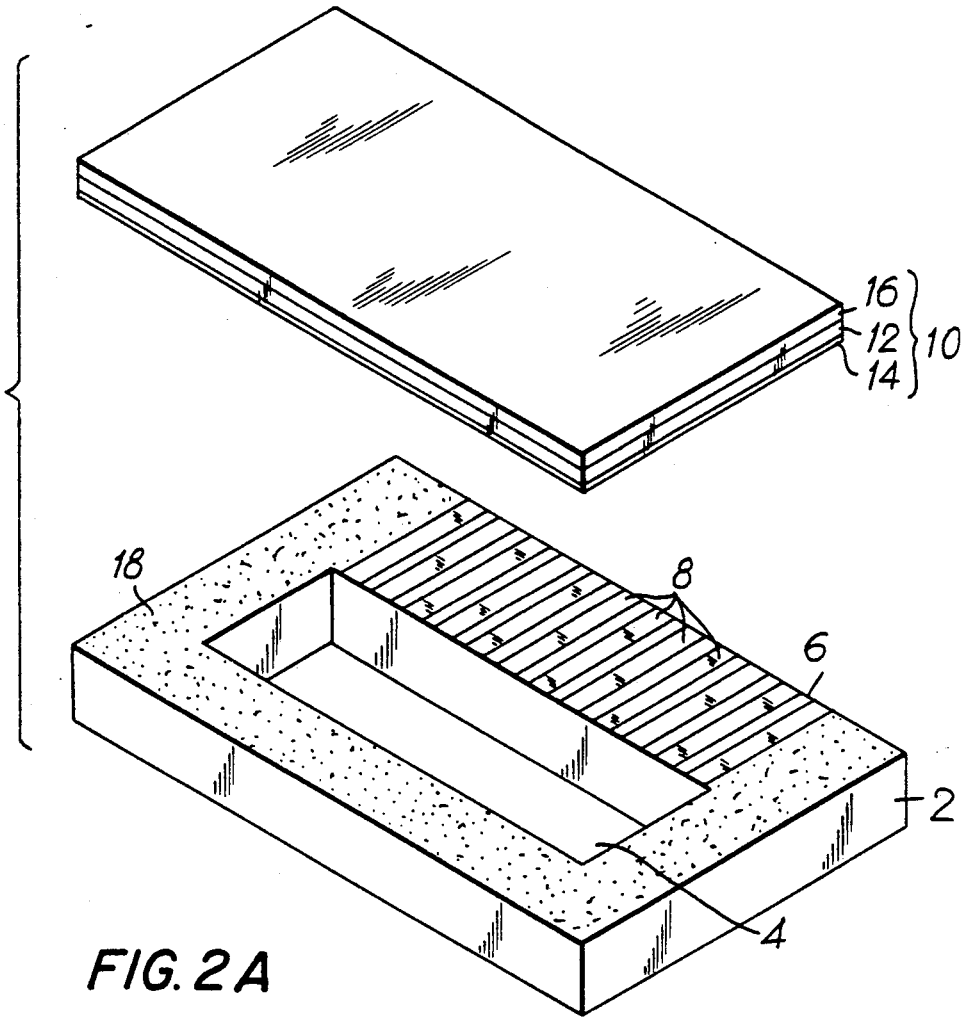
FIGS. 2A, 2B, 2C and 2D are perspective views showing steps in a process of forming the print head drive assembly of FIG. 1.
Figure 2B:
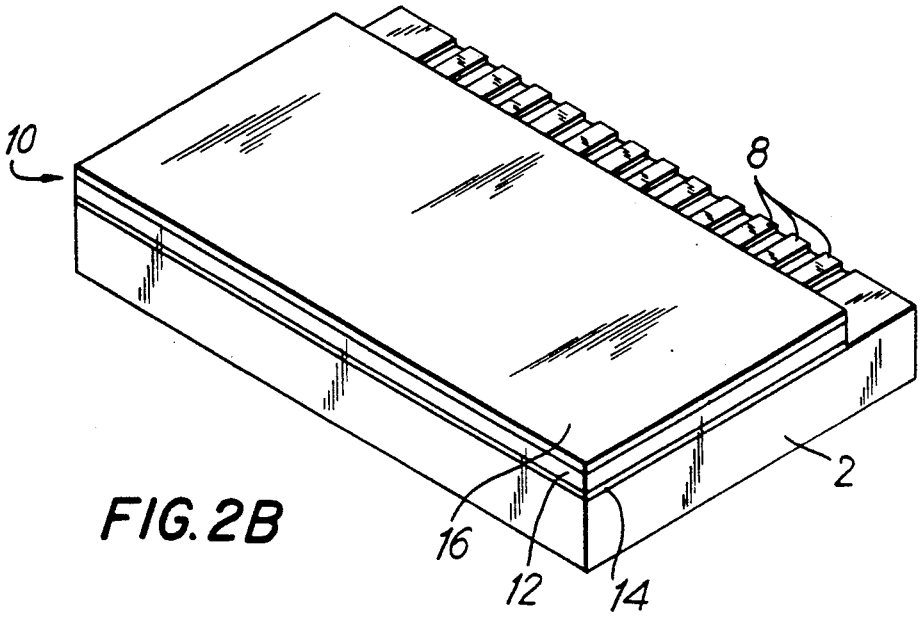
Figure 2C:
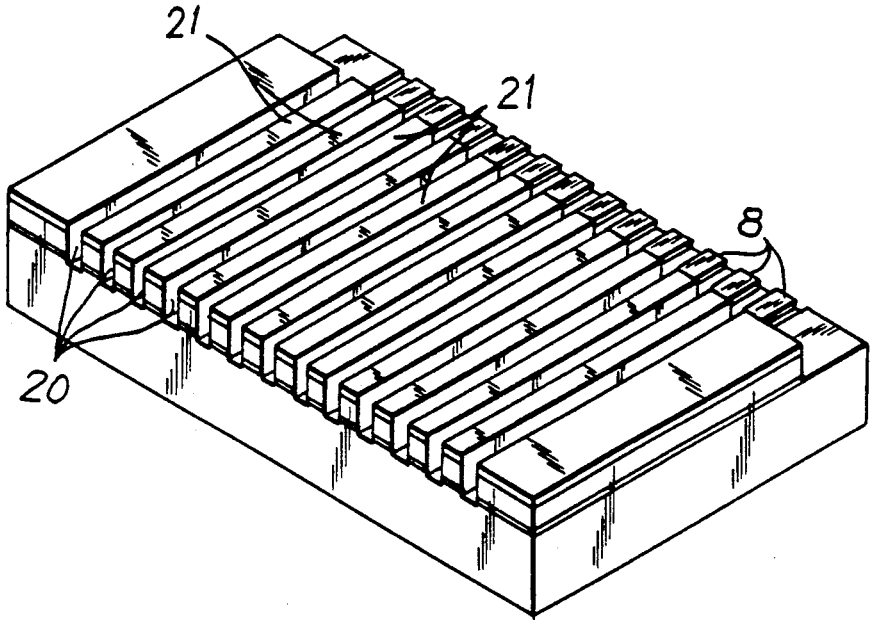
Figure 2D:
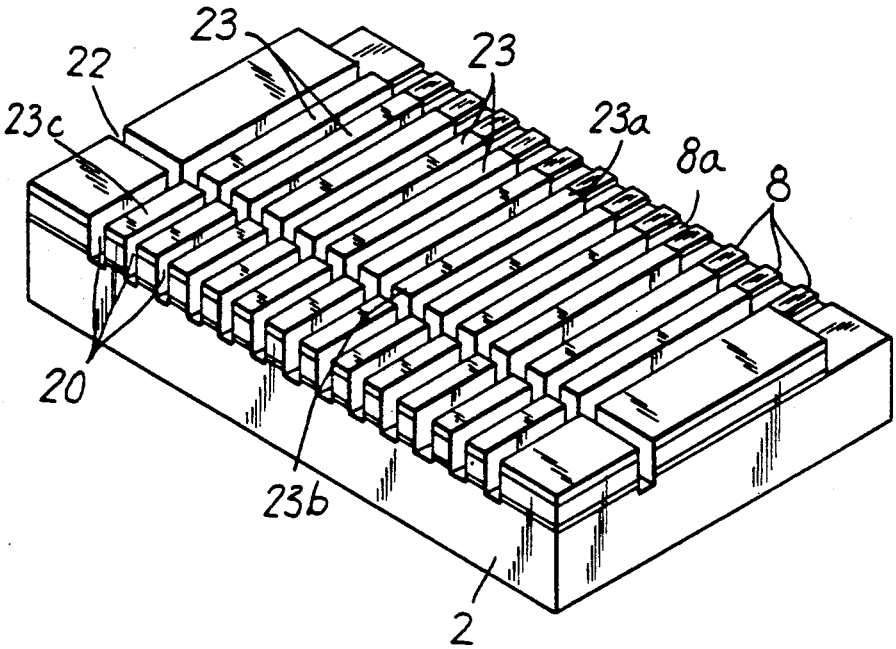

The steps for forming drive assembly 201 are illustrated in FIGS. 2A through 2D and are as follows. FIG. 2A shows a vibrating plate 10 before plate 10 is divided into reed pieces 23. Vibrating plate 10 includes a piezoelectric plate 12, formed by molding a piezoelectric material capable of curving upon application of an electric field into a thin plate. Appropriate materials for plate 12 include lead zirconate. An electrode layer 14 is formed on the bottom surface of plate 12, such as by vapor deposition, nonelectrode plating, chemical plating, or sputtering with a conductive material such as nickel. A highly resilient and electrically conductive layer 16 is disposed to the top surface of plate 12. Resilient layer 16 faces the nozzle openings of a print head and is a metal plate bonded to piezoelectric plate 12 by a eutectic bonding process, a conductive adhesive or another appropriate bonding method.

Vibrating plate 10 is positioned on frame 2 as shown in FIG. 2B so that a portion of conductive bands 8 thereon remains exposed. This allows electrical coupling of conductive bands 8 to a connecting cable from an external electric signal source. Vibrating plate 10 is dimensioned so that when positioned on frame 2 no portion protrudes from the other three edges of frame 2 which are aligned with the edges of vibrating plate 10.

The edges of vibrating plate 10 are secured to base frame 2 at conductive bands 8 by a conductive adhesive and to the remaining edge of frame 2 by an ordinary insulating high-molecular adhesive 18. In this manner, conductive bands 8 are electrically coupled to electrode layer 14 and vibrating plate 10 is strongly secured to frame 10.

As shown in FIG. 2C, a plurality of slits 20 are formed through vibrating plate 10, such as by a diamond cutter. Slits 20 pass between conductor bands 8. Slits 20 are spaced apart by the desired width of the reed pieces. This spacing is preferably about 0.2 mm. In this manner, a plurality of vibrating strips 21 are formed from vibrating plate 10. Each strip 21 is integrally formed of metal resilient layer 16, piezoelectric layer 12 and electrode layer 14. During formation of slits 20, vibrating plate 10 is secured to frame 2 and strips 21 do not break nor split during their formation, even from the vibration of a diamond cutter.

During the slitting process, a plurality of grooves 8*a* are also formed in frame 2 between adjacent conductive bands 8. Conductive bands 8 of base frame 2 thereby become electrically isolated from each other and thereby remain independent terminal portions even if conductive adhesive is spread across the upper surface of edge 6. Accordingly, a plurality of independent vibrating strips 21 having terminals in the form of conductor bands 8 separated by slits 20 are formed on frame 2. Slits 20 are cut in a direction parallel to conductive bands 8 and extend the full length of vibrating plate 10.

As shown in FIG. 2D, a similar slitting process is used to form a cross-slit 22 orthogonal to strips 21 which extend the full width of vibrating plate 10. Cross-slit 22 transforms each vibrating strip 21 into a vibrating reed piece 23, supported by frame 2 as a cantilever. Fixed ends 23*a* of reed pieces 23 are physically secured to frame 2 and electrically coupled to conductor bands 8 by conductive adhesive. An opposite end 23*c* remains secured to frame 2 and cantilever portion 23*b* of reed piece 23 becomes a vibrating free end.

Referring again to FIG. 1, drive assembly 201 also includes a bar-shaped spacer 24 disposed across first end 23*a* of reed pieces 23 and a nozzle forming plate 30 disposed over the assembly. Nozzle forming plate 30 includes a plurality of holes forming nozzle openings 32 aligned with orthogonal slit 22 as described in more detail below. Spacer 24 is provided to set the spacing between cantilever ends 23*b* of reed pieces 23 and corresponding nozzle openings 32. Spacer 24 is sized so that in the quiescent state, reed pieces 23 are preferably no more than about 200 μm from nozzle openings 32. This is a typical separation through which the ink can rise by virtue of surface tension (capillary action), but depends on the characteristics of the ink and print head materials. A more preferable range is between about 5 to 30 μm.

Spacer 24 extends parallel to the arranged direction of reed pieces 23 and is secured by a conductive adhesive at a position where it will not influence the vibration of reed pieces 23, or the position near conductive bands 8 of frame 2. Spacer 24 can be formed of a conductive material and acts as a common electrode, electrically coupling resilient layers 16 of reed pieces 23.

Figure 3:
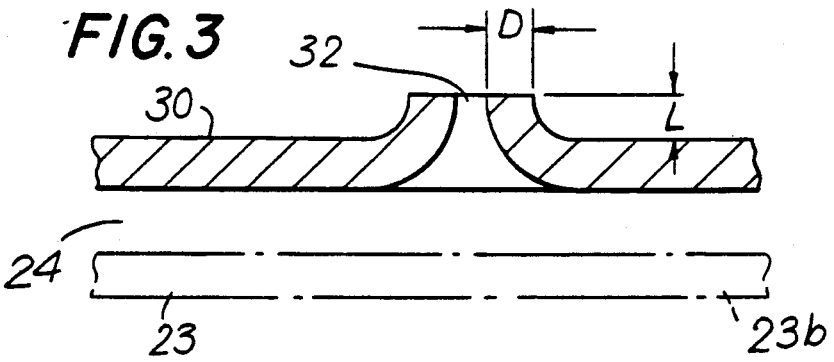
FIG. 3 is a cross-sectional view of a nozzle opening formed in a nozzle forming plate of a print head formed in accordance with the invention.
Figure 4:
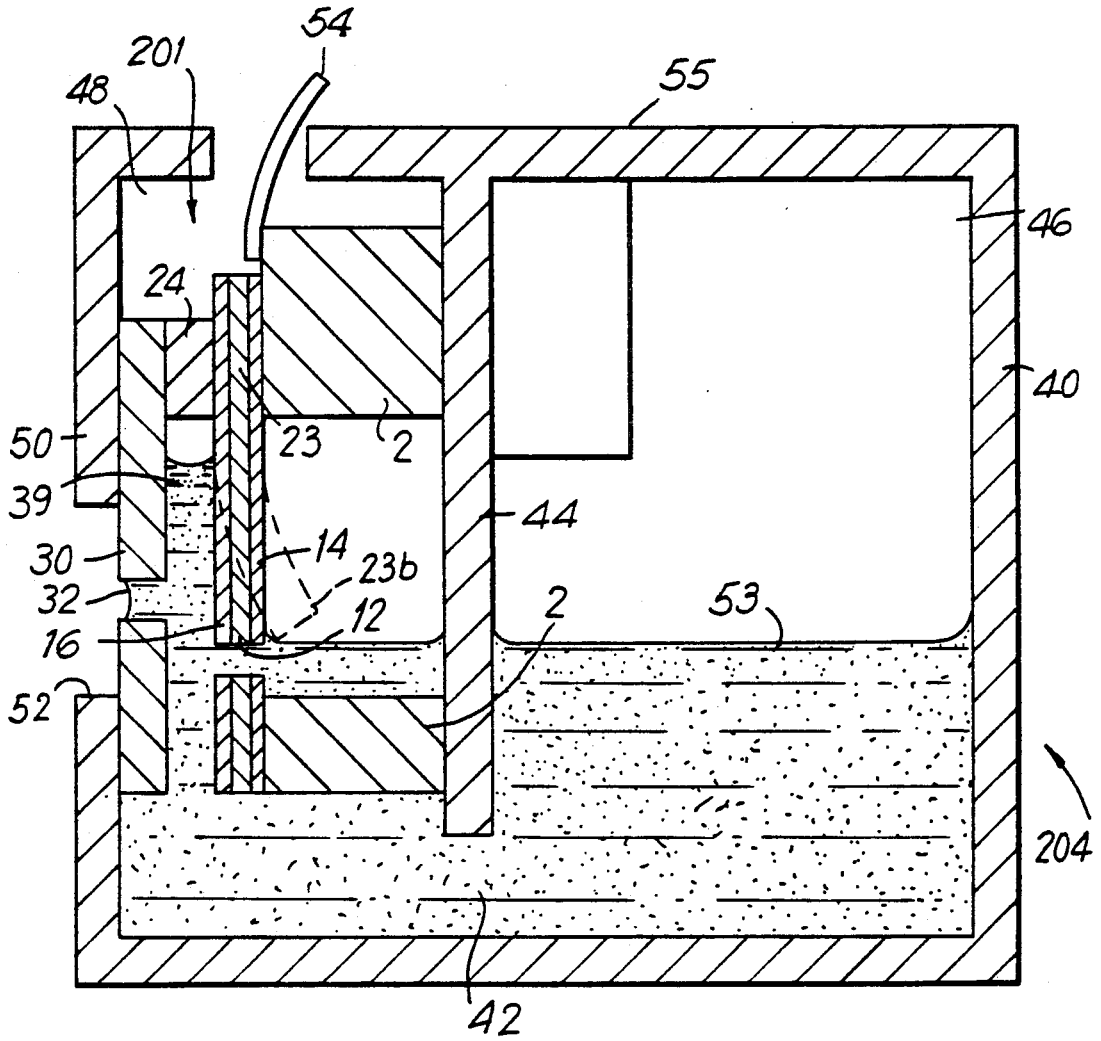
FIG. 4 is a cross-sectional view of an ink jet print head constructed and arranged in accordance with the invention.

A print head 204 including nozzle forming plate 30 constructed in accordance with the invention is shown in FIG. 4. A partial sectional view of nozzle forming plate 30 is shown in FIG. 3. Nozzle forming plate 30 can include one or more rows of nozzle openings 32 formed therethrough. Nozzle openings 32 are in alignment with the tips or cantilever ends 23*b* of reed pieces 23. As shown in FIG. 3, each nozzle opening 32 is funnel shaped and progressively widens toward the nozzle inlet that faces reed piece 23. The opposite ejection side of nozzle opening 32 protrudes from the surface of nozzle forming plate 30 by a height L which is preferably about 10 to 150 μm. The thickness D of the nozzle point is preferably no more than about 150 μm. Nozzle opening 32 can be formed concurrently with a substrate forming step by an electroforming process.

As shown in FIGS. 1 and 4, nozzle forming plate 30 is secured to the surface of spacer 24 after the distances between nozzle openings 32 and free ends 23*a* of reed pieces 23 are made uniform. The spacing between reed piece 23 and nozzle opening 32 is determined by the thickness of spacer 24 and metal plates 16 of reed pieces 23 are electrically coupled by spacer 24.

After nozzle forming plate 30 is mounted to drive assembly 201, the individual signal wires of a flexible cable for electrically coupling drive assembly 201 with an external drive circuit (not shown) are secured to the corresponding conductive bands 8 of frame 2. A common ground wire is electrically coupled and physically secured to spacer 24. The lead wires are thereby coupled to conductive bands 8 of frame 2 in a simple manner compared to conventional processes of connecting the signal wires to conventional reed pieces.

FIG. 4 shows an embodiment of ink jet print head 204 that includes drive assembly 201. Throughout the application, similar elements are assigned the same reference numerals. Print head 204 includes a housing 40 which is divided into a jetting chamber 48 and a storage chamber (ink tank) 46 by a partition plate 44. Ink tank 46 also includes a heater 55 to maintain the ink at a temperature best suited for printing. Drive assembly 201 is positioned in jetting chamber 48. An opening 42 is formed in a lower section of partition plate 44 to permit ink to flow from tank 46 to jetting chamber 48.

Print head 204 includes a front wall 50 formed with an ink orifice 52. Frame 2 of drive assembly 201 is secured to partition plate 44 and nozzle forming plate 30 is positioned against wall 50 with nozzle openings 32 positioned at ink orifice 52. Spacer 24 separates nozzle forming plate 30 from reed pieces 23 to define an ink gap 39 therebetween.

A quantity of ink 53 which is not electrically conductive, such as an oil ink, is placed into ink tank 46 of housing 40. Ink 53 flows through opening hole 42 of partition plate 44 into jetting chamber 48 and travels up ink gap 39 between nozzle forming plate 30 and reed pieces 23 by capillary action due to the surface tension of ink 53. Ink 53 will reach a level high enough to immerse cantilever ends 23*b* of reed pieces 23 in ink 53 and ink 53 will be positioned between cantilever ends 23*b* and nozzles 32.

A print signal is supplied through a signal cable 54 to conductor band 8 and electrode layer 14 of reed piece 23. Metal resilient plate 16 is grounded. An electric field is thereby generated between electrode layer 14 and metal resilient plate 16 and the field is imposed on piezoelectric layer 12. Piezoelectric layer 12 and cantilever end 23*b* of reed piece 23 curves backward from nozzle opening 32 as illustrated by the dotted line in FIG. 4. First end 23*a* is secured to frame 2 which acts as a supporting portion. When the voltage level returns to zero, the deformation retaining power of piezoelectric plate 12 disappears instantly. The mechanical energy in metal resilient plate 16 is instantly released and reed piece 23 rapidly returns toward nozzle opening 32. As reed piece 23 is displaced toward nozzle opening 23, it exerts dynamic pressure on ink 53. A drop of liquid ink 53 is thereby selectively ejected through nozzle opening 32.

Because individual reed pieces 23 are separated from each other by slits 20 and are secured to frame 2 which is a rigid body, the vibration of one reed piece 23 does not significantly influence other reed pieces 23 of the assembly. Moreover, because the individual piezoelectric layers 12 of corresponding reed pieces 23 are separated from each other by slits 20, any signal to electrode layer 14 or resilient metal plate 16 of one reed piece 23 will not act on the piezoelectric layer 12 of a different reed piece 23. Thus, electrical and mechanical interference among reed pieces 23 is avoided.

Figure 5A:
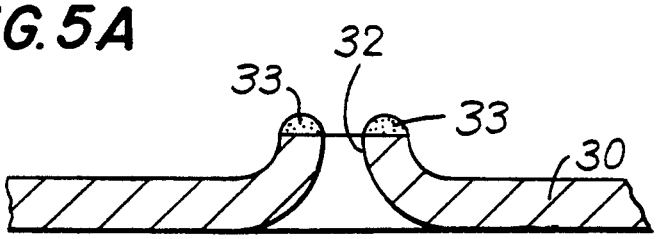
FIGS. 5A, 5B and 5C are cross-sectional views of a nozzle plate showing the behavior of an ink drop which adheres to the tip of the nozzle opening of a print head formed in accordance with the invention.
Figure 5B:
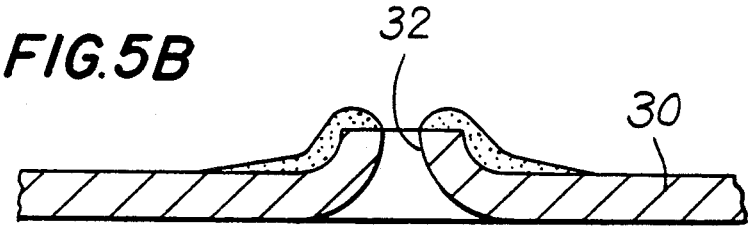
Figure 5C:
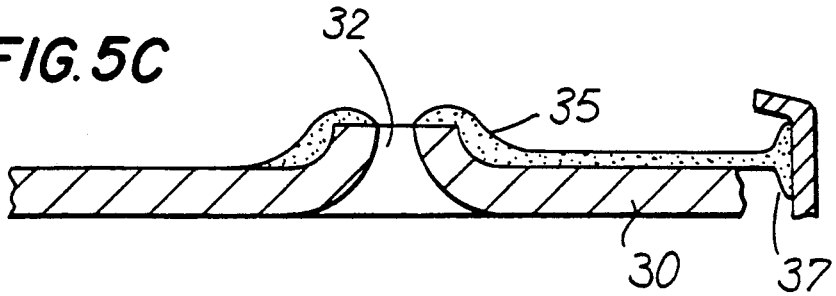

FIG. 5A shows a portion of an ink drop 33 which was ejected through nozzle opening 32 and adheres to the tip of nozzle opening 32 due to surface tension of ink drop portion 33. Liquid drop portions 33 can gradually expand on the surface of nozzle forming plate 30 by the force of gravity and/or surface tension as shown in FIG. 5B. However, because the tip of nozzle opening 32 protrudes from the surface of nozzle forming plate 30 in the direction of ink drop ejection, a quantity of ink 35 adhering to the surface of nozzle forming plate 30 will not block nozzle opening 32. Thus, the ink drops ejected from nozzle 32 will fly freely in the direction defined by nozzle opening 32. Ink 35 adhering to the surface of nozzle forming plate 30 can be collected through a flow path 37 as shown in FIG. 5C.

Figure 6:
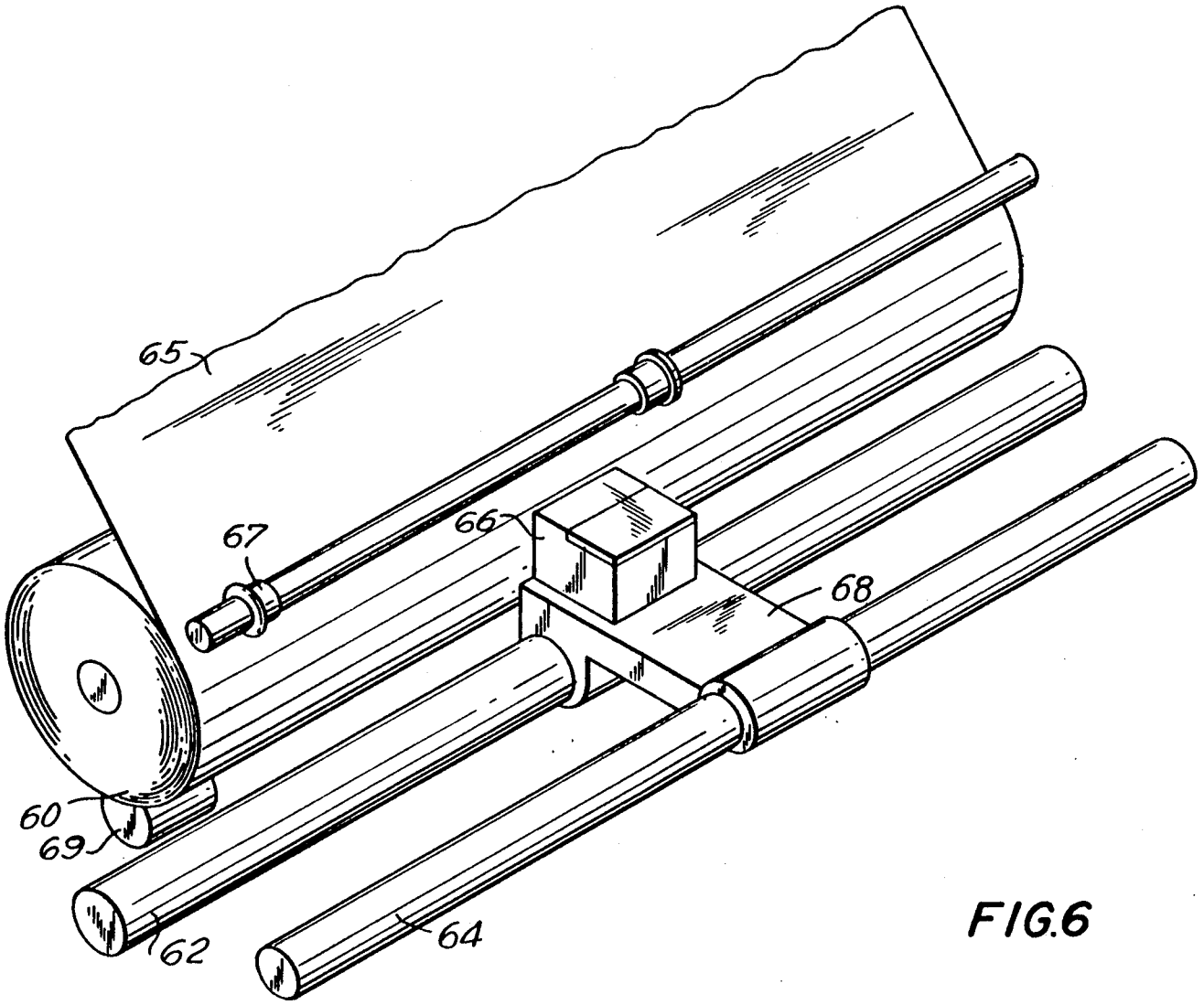
FIG. 6 is a perspective view of a portion of a printer including an ink jet print head constructed and arranged in accordance with the invention.

FIG. 6 shows a portion of an ink jet printer including a print head 66, constructed similarly to print head 204. Print head 66 is mounted on a carriage 68 which is slidably supported by a pair of guide members 62 and 64 which are positioned parallel to a platen 60. Print head 66 will form dots of ink corresponding to print data by jetting ink drops toward a sheet of recording paper 65 by moving in the widthwise direction of paper 65 which is positioned on platen 60 by a paper bail 67 and a paper feed roller 69.

Figure 7:
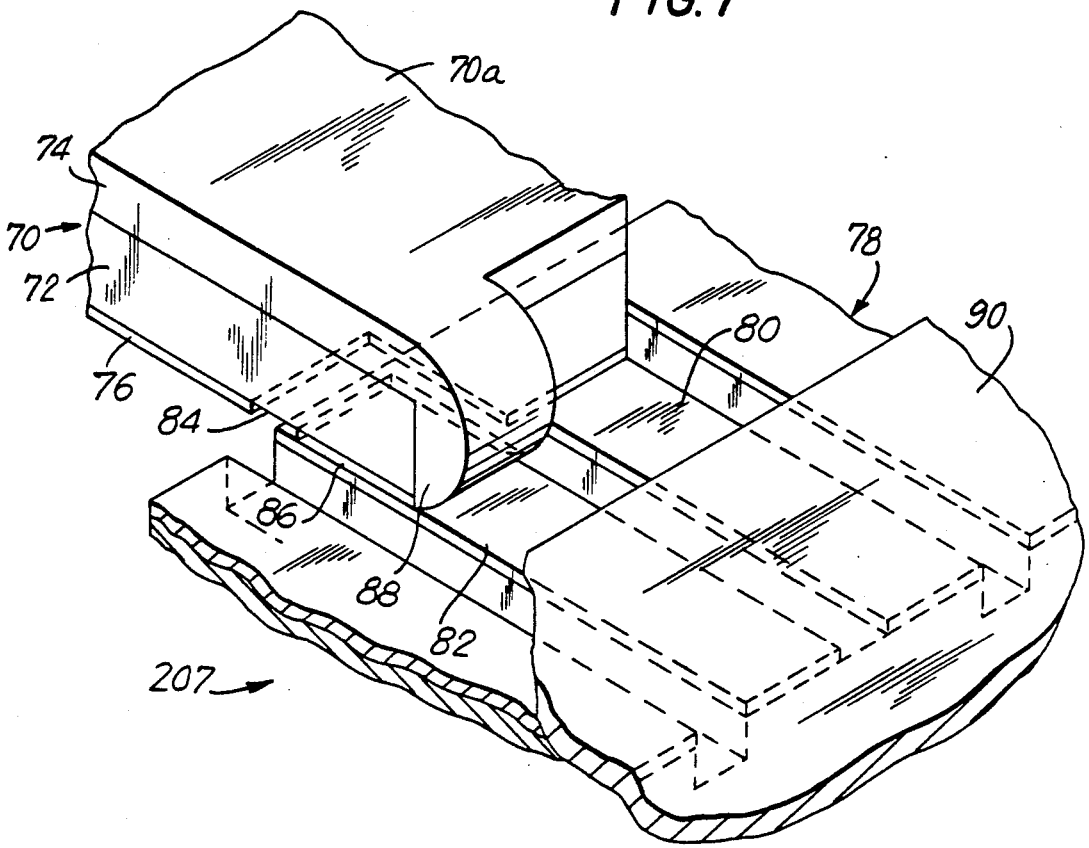
FIG. 7 is perspective view of a portion of the drive assembly of ink jet print head constructed in accordance with the invention.

FIG. 7 shows a drive assembly 207 constructed in accordance with another embodiment of the invention. A plurality of reed pieces 70 of drive assembly 207 are configured similar to reed piece 23 shown in FIG. 2D and formed of piezoelectric layer 72 with an electrode layer 76 formed on one surface and a metal resilient plate 74 disposed on the other surface. Electrode layer 76 and metal resilient plate 74 of reed piece 70 are electrically coupled to external signal wires. Metal resilient plate 74 can be secured to piezoelectric layer 72 by a eutectic bonding process or by using a conductive adhesive. Electrode layer 76 can be formed on piezoelectric layer 72 by an electroforming process or a vapor deposition process.

A frame 78 of drive assembly 207 is similar to frame 2 of drive assembly 201. One edge of frame 78 is provided with a plurality of separated electrically conductive conductor bands 80 and 82. A fixed end 70*a* of reed piece 70 is coupled to this edge of frame 78. Conductive bands 80 and 82 are dimensioned to divide reed piece 70 widthwise into two portions.

A portion of electrode layer 76 which faces conductive band 82 is formed with an L-shaped notch 84. Notch 84 leaves an island-like terminal portion 86 on the bottom end of reed piece 70. Terminal island 86 is separated from the remainder of electrode layer 76 and is mounted on conductive band 82. Terminal island 86 is electrically coupled to metal resilient plate 74 by a an electrically conductive conductor member 88 which is formed over the end of fixed end 70*a* of reed piece 70.

Reed piece 70 is secured to conductive bands 80 and 82 with electrically conductive adhesive. In this arrangement, electrode layer 76 is electrically coupled to conductor band 80 and metal resilient plate 74 is electrically coupled to the other conductor band 82 by conductor member 88 and terminal island 86.

The lead wires of a signal cable 90 including both signal and ground leads are electrically coupled to exposed ends of conductor bands 80 and 82. When signals are supplied to electrode layer 76 and metal resilient plate 74 through conductor bands 80 and 82, reed piece 70 curves and recovers to propel drops of ink in the same manner as described in connection with the initial embodiment.

This embodiment of the invention has been described in terms of a single reed piece 70 for convenience of explanation. However, the same advantages can be obtained by first forming terminal islands 86 and conductor members 88 on a vibrating plate such as plate 10 shown in FIG. 2A, securing the vibrating plate to base member 78 and slitting the plate to form a plurality of individual reed pieces 70.

Figure 8A:
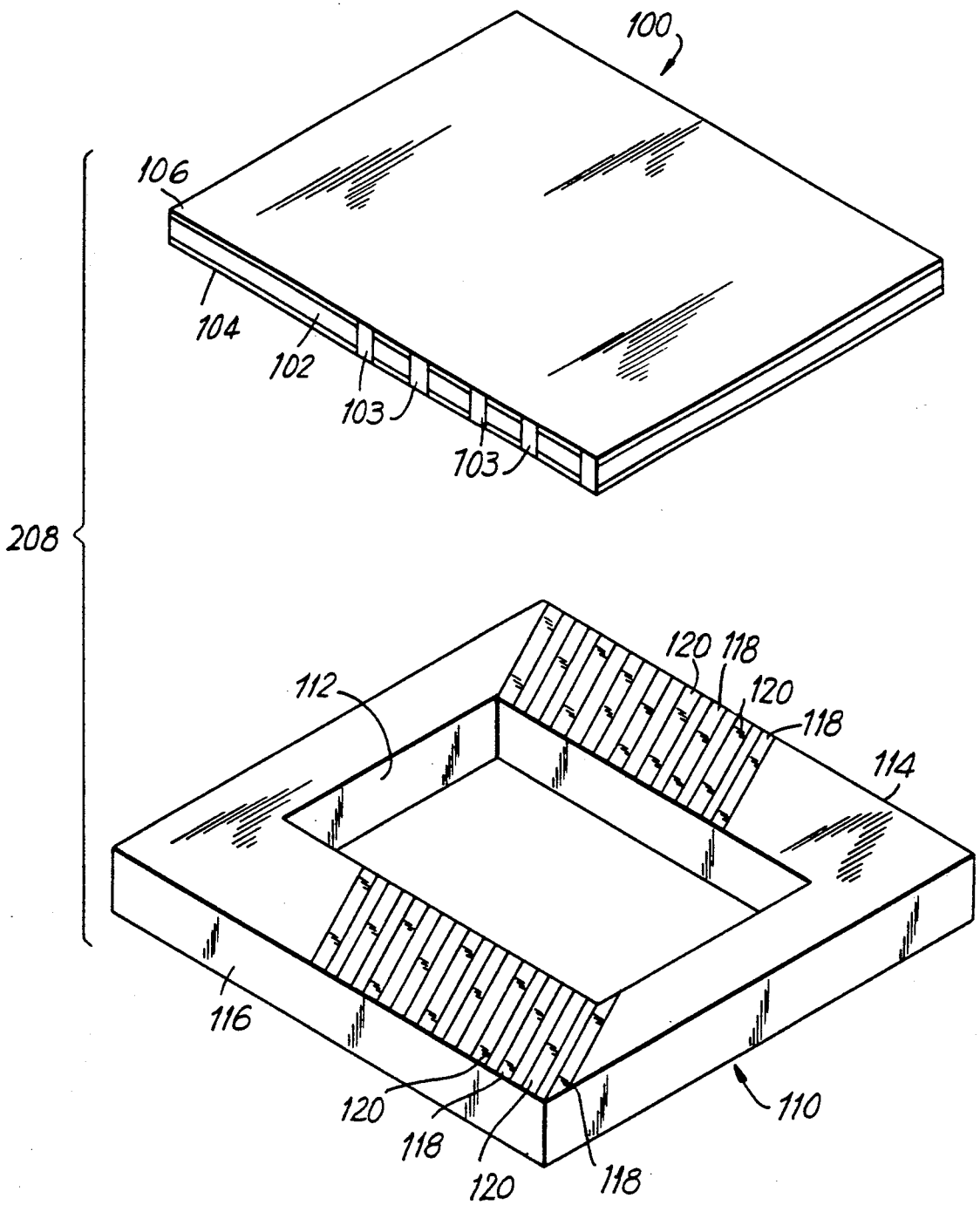
FIGS. 8A and 8B are exploded perspective views showing a drive assembly for an ink jet print head constructed and arranged in accordance with another embodiment of the invention.
Figure 8B:
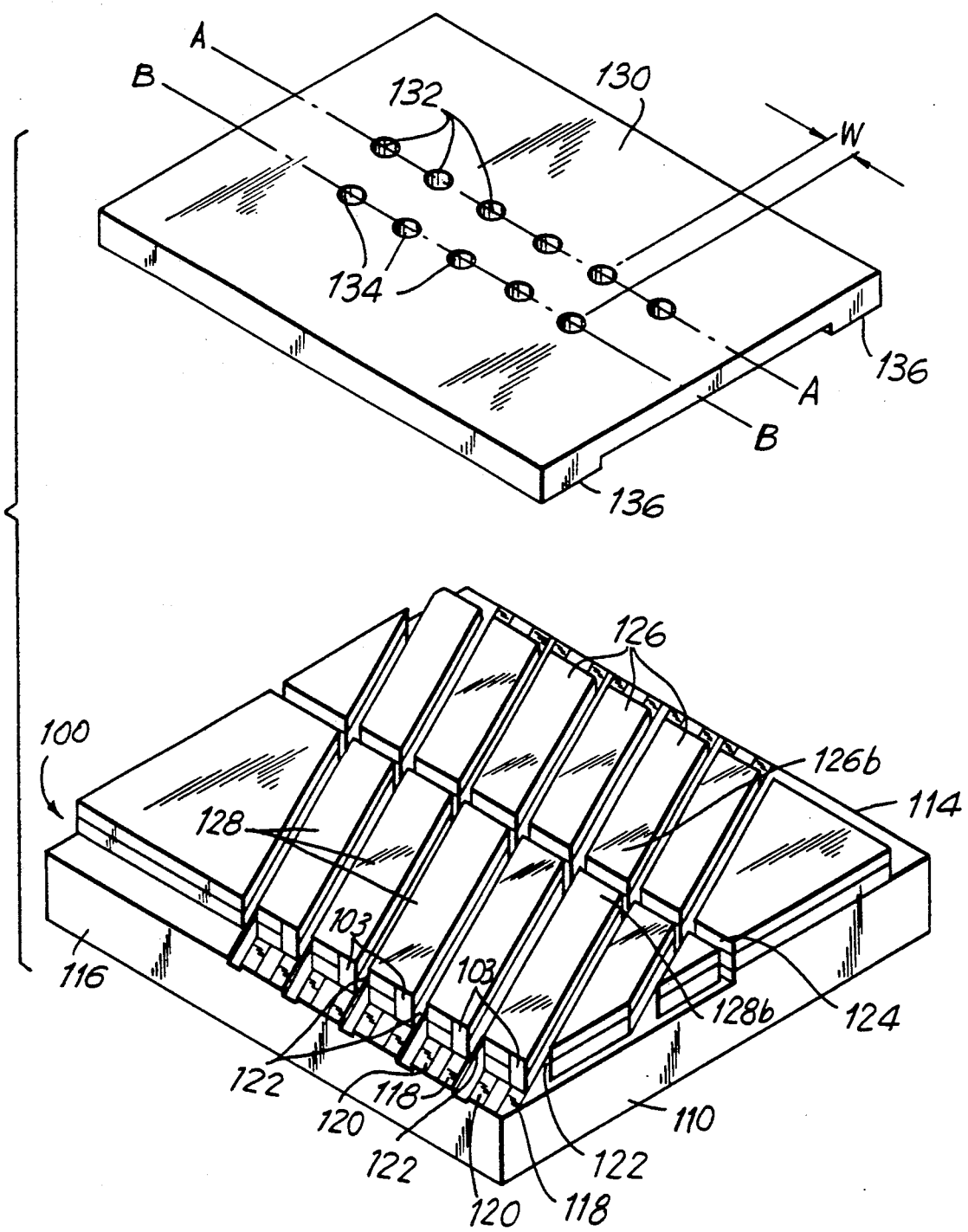

FIGS. 8A and 8B show a drive assembly 208 formed in accordance with yet another embodiment of the invention. Drive assembly 208 is formed from a vibrating plate 100 that is similar to vibrating plate 10, shown in FIG. 2A. Vibrating plate 100 includes a thin piezoelectric layer 102 with an electrode layer 104 formed on one surface and a metal resilient plate 106 formed on the opposite surface of piezoelectric layer 102. Metal resilient plate 106 serves as a spring element and as an electrode. A plurality of electrically conductive conductor members 103 are formed along the side edge of plate 100 and extend from metal resilient plate 106 to electrode layer 104.

Vibrating plate 100 is formed with a plurality of L-shaped notches, similar to notch 84 shown in FIG. 7 to yield a plurality of terminal islands in electrode layer 104. The L-shaped notches are positioned to form the terminal islands at portions of electrode layer 104 in contact with conductor members 103 so that the terminal islands are electrically coupled to metal resilient plate 106. Each terminal island is also formed in a portion of plate 100 opposing one of a plurality of a pair of electrically conductive conductor bands 118 and 120 that are formed on a frame 110. For example, the terminal island can face conductive band 118 and not conductive band 120. The terminal island is electrically coupled to metal resilient plate 106 by an electrically conductive conductor member 103.

Frame 110 is formed of a rigid and electrically insulating material, such as glass or ceramic material. The central portion of frame 110 is formed with a rectangular aperture 112. The top surfaces of two opposite edges 114 and 116 of frame 110 each have a plurality of pairs of conductor bands 118 and 120 which are electrically isolated from each other. A pair of conductive bands 118 and 120 each occupy the width of one reed piece. Conductive bands 118 and 120 are preferably formed by vapor deposition of metal or by printing with conductive adhesive.

Referring to FIG. 8B, vibrating plate 100 is disposed on frame 110 such that electrode layer 104 faces conductive bands 118 and 120 and the terminal islands of electrode layer 104 oppose conductive bands 118. Electrode layer 104 is secured to base member 110 and electrically coupled to conductive bands 118 and 120, preferably with a conductive adhesive Electrode layer 104 is secured to the other two edges of frame 110, preferably with an ordinary non-conductive adhesive.

After vibrating plate 100 is secured to frame 110, a plurality of slits 122 are formed parallel with and outside of pairs of conductive bands 118 and 120. A second cross-slit 124 parallel to the conductive band edges 114 and 116 of frame 110 is then formed through plate 100 across slits 122. This forms two cantilever portions 126*b* and 128*b* from each reed piece.

A nozzle plate 130 is disposed on plate 100. Nozzle plate 130 includes a first row of nozzles arranged along line A—A and a second row of nozzles arranged along line B—B aligned with the rows of cantilever portions 126*b* and 128*b*.

Second slit 124 is formed to pass approximately midway between nozzle arrangement lines A—A and B—B. Consequently, vibrating plate 100 is formed into two groups of separated reed pieces 126 and 128, each group having one end secured to one of edge 114 and edge 116 of base member 110. The other end of reed pieces 126 and 128 is free. Metal resilient plate 106 of each reed piece 126 and 128 is electrically coupled through a conductive member 103, a terminal island and a conductive adhesive to conductive band 118 and electrode layer 104 is electrically coupled through a conductive adhesive to conductive band 120.

Nozzle forming plate 130 includes a plurality of nozzle openings 132 and 134 formed in a zigzag offset configuration and in alignment with cantilever ends 126*b* and 128*b* of reed pieces 126 and 128 Nozzle openings 132, corresponding to first arrangement line A—A, are aligned with cantilever ends 126*b* of reed pieces 126, which are secured to edge 114 of base member 110. Nozzle openings 134 corresponding to the second arrangement line B—B and are aligned with cantilever ends 128*b* of reed pieces 128 which are secured to edge 116 of base member 110.

Portions of nozzle forming plate 130 coming into contact with the fixed end of reed pieces 126 and 128 are formed with a thick spacer portion 136 to define the spacing between nozzle openings 132 and 134 and cantilever ends 126*b* and 128*b* of reed pieces 126 and 128, respectively.

A print head can produce an increased density of printed dots by employing a nozzle plate and drive assembly configured in accordance with the embodiment shown in FIG. 8B. By employing this configuration, the distance W between nozzle openings can be decreased which shortens the inter-spacing of the dots without decreasing the widthwise size of each reed piece 126 and 128. Consequently, the nozzle openings can be formed or arranged with a pitch that is smaller than the width of a single reed piece.

Second slit 124 may be formed orthogonal to first slits 122. However, it is preferable that the angle of intersection between second slit 124 and first slits 122 be non-orthogonal and the nozzle openings of both rows should be formed in the nozzle plate at a one-half pitch shift.

The embodiment shown in FIG. 8B includes thick portions 136 formed on both edges of nozzle forming plate 130, rather than employing a spacer member to adjust the spacing between nozzle forming plate 130 and the reed pieces 126 and 128. The same effect can be obtained by making the bottom surface of nozzle forming plate 130 flat and securing it to a spacer member of a given thickness as in the initial embodiment.

Figure 9:
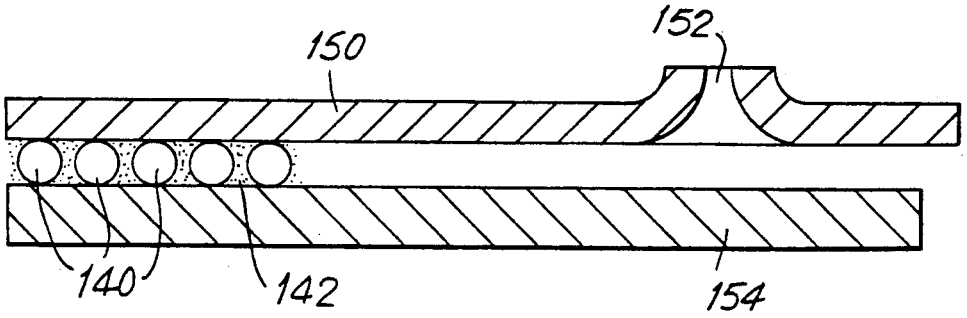
FIG. 9 is a cross-sectional view showing a nozzle plate secured to a reed piece in accordance with a further embodiment of the invention.

Although the foregoing embodiments regulate the spacing between the nozzle openings and the reed pieces by the use of a spacer member or by including thick portions formed on the nozzle forming plate, other arrangements are possible For example, FIG. 9 shows a nozzle forming plate 150 secured to a reed piece 154 by a binding material which is prepared by mixing an adhesive 142 with beads 140 that have an outer diameter substantially equal to a desired spacing. As shown in FIG. 9, the spacing between a nozzle opening 152 and a free ends of reed piece 154 is defined by the outer diameter of beads 140. This arrangement avoids the step of interposing a spacer.

Accordingly, to provide an ink jet print head in accordance with preferred embodiments of the invention, a vibrating plate for an ink jet drive assembly is formed of a piezoelectric plate having a resilient plate on one surface and an electrode layer on the other surface. The vibrating plate is secured to a rectangular frame or base member having a rectangular window therein by an adhesive or the like. The vibrating plate is then cut into strips and each strip is cut again cross-wise at a position facing the window in the base member in a direction substantially orthogonal to the first cut lines. Consequently, one end of each strip is secured to the base member and the other end is left free. Thus, reed pieces are formed in a cantilever form.

A nozzle forming plate is disposed in alignment with the reed pieces to form a drive assembly which is immersed in ink. When an electric field is imposed on the piezoelectric plate, the reed piece curves away from the ink orifice or nozzle opening. When the field is removed, the reed piece recovers by virtue of its resiliency. During this recovery, a resultant dynamic pressure acts on the ink to eject an ink drop through a nozzle opening formed in the nozzle forming plate.

Because each reed piece is formed by cutting the vibrating plate from one edge to the other, all of the reed pieces are physically and electrically separated from each other. Vibration of and an electrical signal to one reed piece will not disturb other adjacent reed pieces. Thus, vibration is stably generated and the ink drops are jetted in a reliable manner.

It will thus be seen that the objects set forth above, among those made apparent from the preceding description, are efficiently attained and, since certain changes may be made in carrying out the above method and in the article set forth without departing from the spirit and scope of the invention, it is intended that all matter contained in the above description and shown in the accompanying drawings shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

What is claimed is:

1. An ink jet print head including a drive assembly for propelling drops of ink, comprising:

a base having two opposing edges defining a free space therebetween and including a plurality of electrically conductive leads separated from each other on both edges;

a plurality of individual elongated reed pieces for selectively propelling ink from the print head, each reed piece having a securing end and an opposed cantilever end, the reed pieces physically secured to the base at the securing end and electrically coupled to at least a portion of the conductive leads and the opposite cantilever end being capable of being displaced and the reed pieces extend into the free space from each edge towards reed pieces extending from the opposite edge with a space therebetween;

the reed pieces including a piezoelectric layer having an electrode layer disposed on one surface and a resilient layer that is electrically conductive and physically resilient, disposed on the opposite surface of the piezoelectric layer, the reed piece capable of deforming in response to the application of an electric field and returning to its original state after an application of an electric field to the reed piece ceases.

2. The ink jet print head of claim 1, wherein each reed piece is disposed on a portion of each of a pair of the conductive leads and the electrode layer is electrically coupled to one lead of the pair and the resilient layer is electrically coupled to the other lead of the pair and a portion of each lead is exposed and can be electrically coupled to an external source.

3. The ink jet print head of claim 1, wherein each reed piece is disposed on a portion of each of a pair of the conductive leads and the electrode layer is electrically coupled to one lead of the pair and the resilient layer is electrically coupled to the other lead of the pair and a portion of each lead is exposed and can be electrically coupled to an external source.

4. The ink jet print head of claim 1, wherein the resilient layer includes a metal plate.

5. The ink jet print head of claim 1, wherein the electrode layer of each reed piece is coupled to the conductive lead with electrically conductive adhesive.

6. The ink jet print head of claim 1, wherein the two edges are substantially parallel and the reed pieces extend at a non-orthogonal angle from the edges.

7. The ink jet print head of claim 6, wherein the reed pieces from one edge are separated from the reed pieces from the other edge by a gap extending in a direction substantially parallel with the two edges.

8. The ink jet print head of claim 1, wherein the electrode layers of the reed pieces are electrically coupled.

9. The ink jet print head of claim 1, wherein the resilient layers of the reed pieces are electrically coupled.

10. The ink jet print head of claim 1, wherein the electrode layers of the reed pieces are electrically coupled.

11. The ink jet print head of claim 1, wherein the resilient layers of the reed pieces are electrically coupled.

12. The ink jet print head of claim 1, further including a nozzle plate having a plurality of nozzle openings formed therethrough disposed on the portion of the reed pieces secured to the base, the nozzle openings aligned with the free cantilever ends of the reed pieces and the resilient layer of the reed pieces facing the nozzle openings.

13. The ink jet print head of claim 1, further including a nozzle plate having a plurality of nozzle openings formed therethrough disposed on the portion of the reed pieces secured to the base, the nozzle openings are aligned with the free cantilever ends of the reed pieces and the resilient layer of the reed pieces facing the nozzle openings.

14. An ink jet print head, comprising:

a housing having a front wall;

a nozzle plate having a plurality of ink nozzles formed therethrough, the nozzle plate positioned at the front wall with the nozzle orifices exposed;

drive assembly means for propelling ink through the nozzles, the drive assembly means including a base having two opposing edges defining a free space therebetween, a plurality of separated piezoelectric reed pieces having free ends secured to both edges of the base and extending into the free space from each edge toward reed pieces extending from the opposite edge with a space therebetween, each reed piece including a layer of piezoelectric material with an electrode layer of electrically conductive material on one surface, and an electrically conductive and physically resilient layer disposed on the other surface of the piezoelectric layer;

the drive assembly means positioned behind the nozzle plate with the free ends of the reed pieces opposing nozzles for corresponding therewith, the reed pieces spaced from the nozzle plate to define an ink gap therebetween; and an ink reservoir portion defined by the housing, the drive assembly and housing constructed and arranged so that ink will flow by capillary action from the reservoir portion into the ink gap and between the nozzles and the free ends of the reed pieces.

15. The ink jet print head of claim 14, further including a spacer, formed of electrically conductive material disposed between the nozzle plate and the portions of the reed pieces secured to the base with the spacer electrically coupled to the resilient layer of the reed pieces to serve as a common electrode for the reed pieces.

16. The ink jet print head of claim 14, wherein the ink gap is between 5 μm and 200 μm wide.

17. The ink jet print head of claim 14, wherein the nozzles are funnel shaped and protrude about 10 μm to 150 μm from the outer surface of the nozzle plate.

18. The ink jet print head of claim 14, including a partition wall within the housing separating the interior of the print head into an ink storage region and an ink jetting region, wherein the base of the drive assembly means is mounted on the partition wall.

19. The ink jet print head of claim 14, wherein both edges include a plurality of conductive leads coupled to the reed pieces.

20. The ink jet print head of claim 19, wherein each reed piece is disposed on a portion of each of a pair of the conductive leads and the electrode layer is electrically coupled to one lead of the pair and the resilient layer is electrically coupled to the other lead of the pair and a portion of each lead is exposed and can be electrically coupled to an external source.

21. The ink jet print head of claim 19, wherein the two edges are substantially parallel and the reed pieces extend at a non-orthogonal angle from the edges.

22. The ink jet print head of claim 21, wherein the reed pieces from one edge are separated from the reed pieces from the other edge by a gap extending in a direction substantially parallel with the two edges.

23. The ink jet print head of claim 22, wherein the nozzle plate includes two rows of nozzles in a staggered arrangement and the nozzles of one row are aligned with reed pieces secured to one edge of the base and nozzles of the other row are aligned with reed pieces secured to the other edge.

24. The ink jet print head of claim 23, wherein the pitch of the nozzles is less than the width of the reed pieces.

25. The ink jet print head of claim 19, wherein the electrode layer of each reed piece is coupled to the conductive leads with electrically conductive adhesive.

26. The ink jet print head of claim 14, wherein the base includes electrically conductive leads electrically coupled to the electrode layer and partially exposed to serve as signal leads for the reed pieces.

27. An ink jet print head including a drive assembly for propelling drops of ink, comprising:

a base having a first and a second opposed edges defining a free space therebetween, the top surfaces of the edges including a plurality of electrically conductive leads separated from each other;

a plurality of individual elongated reed pieces for selectively propelling ink from the print head, each reed piece having a securing end and an opposed cantilever end, the reed pieces physically secured to the base at the securing end and electrically coupled to at least a portion of the conductive leads and the opposite cantilever end being capable of being displaced and the reed pieces extend into the free space from each edge towards reed pieces extending from the opposite edge with a space therebetween;

the reed pieces are formed from a piezoelectric layer having an electrode layer disposed on one surface and a resilient layer that is electrically conductive and physically resilient, disposed on the opposite surface of the piezoelectric layer, the reed piece capable of deforming in response to the application of an electric field and returning to its original state after an application of an electric field to the reed piece ceases.

28. An ink jet print head including a drive assembly for propelling drops of ink, comprising:

a base including two opposing edges defining a free space therebetween;

a plurality of separate elongated reed pieces for selectively propelling ink from the print head, each reed piece having a securing end and an opposed cantilever end, the reed pieces physically secured to both edges of said base at the securing end and electrically coupled to conductive leads at the securing end, and the opposite cantilever end being capable of being displaced into the free space and the reed pieces from both edges extend towards each other from opposite edges with a space therebetween; and a nozzle plate having a plurality of nozzle openings formed therethrough, the nozzle plate coupled to the portion of the reed pieces secured to the base, the nozzle openings aligned with the free cantilever ends of the reed pieces.

29. The ink jet print head of claim 28, wherein the reed pieces are formed by separating a layer of material for forming reed pieces by a plurality of parallel cuts and a single cross cut across the parallel cuts.

30. The ink jet head of claim 29, wherein the reed pieces include at leasf three layers, a piezoelectric layer having an electrode layer disposed on one side and a resilient layer which is electrically conductive and physically resilient, disposed on the opposite side of the piezoelectric layer.

31. The ink jet head of claim 30, wherein two sets of reed pieces extend towards each other from the opposite edges of the base and are separated from the reed pieces from the opposite edges of the base by a gap extending in a direction substantially parallel with the two edges.

32. The ink jet print head of claim 31, wherein the nozzle plate includes two rows of nozzles in a staggered arrangement and the nozzles or one row are aligned with reed pieces secured to one edge of the base and the nozzles of the other row are aligned with reed pieces secured to the other edge.

33. The ink jet print head of claim 29, wherein reed pieces extend towards each other from the opposite edges of the base and are separated by a gap extending in a direction substantially parallel with the two edges.

34. The ink jet print head of claim 33, wherein the nozzle plate includes two rows of nozzles in a staggered arrangement and the nozzles of one row are aligned with reed pieces secured to one edge of the base and the nozzles of the other row are aligned with reed piece secured to the other edge.

35. The ink jet print head of claim 28, wherein reed pieces extend towards each other from the opposite edges of the base and are separated by a gap extending in a direction substantially parallel with the two edges.

36. The ink jet print head of claim 35, wherein the nozzle plate includes two rows of nozzles in a staggered arrangement and the nozzles of one row are aligned with reed pieces secured to one edge of the base and the nozzles of the other row are aligned with reed pieces secured to the other edge.

* * * * *